United States Patent [19]

Akiya et al.

[11] Patent Number: 4,636,410

[45] Date of Patent: Jan. 13, 1987

[54] RECORDING METHOD

[75] Inventors: Takashi Akiya, Yokohama; Shigeo Toganoh, Tokyo; Ryuichi Arai, Sagamihara, all of Japan

[73] Assignee: Canon Kabushiki Kaisha, Tokyo, Japan

[21] Appl. No.: 767,362

[22] Filed: Aug. 20, 1985

[30] Foreign Application Priority Data

| | | | |
|---|---|---|---|
| Aug. 29, 1984 | [JP] | Japan | 59-181508 |
| Aug. 29, 1984 | [JP] | Japan | 59-181509 |
| Aug. 29, 1984 | [JP] | Japan | 59-181510 |
| Aug. 29, 1984 | [JP] | Japan | 59-181511 |
| Aug. 29, 1984 | [JP] | Japan | 59-181512 |
| Aug. 29, 1984 | [JP] | Japan | 59-181513 |

[51] Int. Cl.[4] ..... B41M 5/00

[52] U.S. Cl. ..... 427/261; 346/1.1; 346/135.1; 427/212; 427/288; 428/211; 428/329; 428/330; 428/331; 428/537.5

[58] Field of Search ..... 346/135.1, 1.1; 427/261, 212, 288; 428/207, 211, 328, 330, 331, 537.5, 329

[56] References Cited

U.S. PATENT DOCUMENTS

| | | | |
|---|---|---|---|
| 4,481,244 | 11/1984 | Haruta et al. | 346/135.1 |
| 4,496,629 | 1/1985 | Haruta et al. | 346/135.1 |

*Primary Examiner*—Bruce H. Hess

*Attorney, Agent, or Firm*—Fitzpatrick, Cella, Harper & Scinto

[57] ABSTRACT

In a recording method of using droplets of a recording liquid, the recording surface of the recording medium is formed with at least a filler and part of a fibrous substrate present mixedly.

13 Claims, 6 Drawing Figures

RECORDING METHOD

BACKGROUND OF THE INVENTION

1. Field of the Invention

The present invention relates to a recording method and more particularly to improvements in the method of making color records by causing droplets of recording liquids to adhere onto recording media.

2. Description of the Prior Art

Ink-jet recording comprises ejecting droplets of recording liquid (ink) by any of various techniques for discharging ink (e.g. electrostatic attraction, vibrating or displacing ink mechanically by using a piezoelectric device, and driving ink with pressure caused by heating the ink) and causing some or all of the ejected droplets to adhere onto a recording medium such as paper. This recording process draws attention as a recording method for being quieter and enabling high-speed multicolor printing.

In ink-jet recording, chiefly aqueous inks have been used as recording liquids in view of safety and printability while common paper generally has been employed as recording medium. When recording is made by using a recording liquid, it is required that the recording liquid does not run on the recording paper so as not to make the printed letters obscure, and it is desirable that the recording liquid becomes dry rapidly after application so as not to stain the recording surface.

In particular, multicolor ink-jet recording employing two or more different color inks needs to satisfy the following various requirements:

(1) Recording liquids must be quickly absorbed by the recording medium, and an ink dot, when overlapping a dot of previously applied ink of different color, must not mix with or disorder or diffuse it.

(2) Recording liquids must diffuse on the recording medium to an extent that does not increase the diameter of the ink dots more than necessary.

(3) The shape of each ink dot must be nearly a true circle and the perimeter thereof must not become obscure.

(4) Ink dots must have high optical density and distinct perimeter lines.

(5) The recording medium must exhibit a high brightness and a good contrast to the ink dots.

(6) The color of the applied recording liquid must not vary depending on the recording medium used.

(7) Dimensions of the recording medium must be changed little by recording (that is, elongation or wrinkling is minimized).

While it has been understood that the satisfaction of these requirements depend on characteristics of the recording medium and liquid used, no ink-jet recording method meeting all of these requirements has yet been found in practice.

For instance, ink-jet recording performance of recording media depends on the water content of the recording liquids is as follows: Wood-free paper for office purposes, when used together with usual recording liquids (water contents of ca. 70%), exhibits poor ink absorbability and gives nonuniform ink spreading and markedly inferior shapes of ink dots. In the case of the same paper with recording liquids of less water content (up to 50%), the ink absorbability is slightly improved but the shapes and colors of the ink dots are inferior. Commercial non-coated paper, although exhibiting sufficient ink absorbability regardless of water content, gives ink dots of inferior shapes and colors. In the case of coated paper for printing used with recording liquids of higher water content (at least 70%), the resulting ink dots are good in shape but low in optical density and the absorbability of the ink is much inferior. With recording liquids of less water content (up to 50%), on the contrary, this type of paper shows better ink absorbability but gives ink dots of still low optical density.

Ink-jet recording performance of recording media depends on the surface tension of the recording liquids as follows: In ink-jet recording on a conventional recording medium having a recording layer (art paper), recording liquids of high surface tension show low rates of absorption since only fine interstices are present at the recording surface and hence the penetration of such a recording liquid into these interstices is retarded. When recording liquids of low surface tension are used to increase rates of ink absorption, the spread of ink on the recording surface increases, similarly to the case with non-coated paper, and good recording results will not be obtained. These problems conflicting each other have not been solved.

Moreover, ink-jet recording performance of recording media depends on the viscosity of the recording liquids as follows: For ink-jet recording on non-coated paper, recording liquids of relatively high viscosities are rather suited; by use of a recording liquid having a viscosity of at least 12 cp, so-called blotting of ink dots due to the ink spreading over the surface of paper can be avoided. However, recording liquids with a viscosity that is too high have poor absorbability; when such a recording liquid is used, a prolonged time will be required for ink fixing, and other undesirable effects may occur such as different-color ink droplets, an overlapping at the recording surface, mix with one another and ink dots are enlarged more than is necessary or becomes disordered.

For the purpose of avoiding such undesirable matters, the use of coated paper has been proposed. However, existing coated paper, on which the blotting of ink dots can be avoided, are suited rather for recording liquids of low viscosities up to 2 cp, since the ink absorbability of coated paper is low. Recording liquids having viscosities exceeding 2 cp are limited in water resistance, discharge stability, and stability of solutions of recording agents therein.

For ink-jet recording, the image to be recorded, i.e. an original image, is generally divided into equal sections (picture elements), each of which is expressed by one or more ink dots to reproduce the original image on a recording medium. In this recording method, it is necessary to obtain a sufficient picture element density (recording density of one picture element as a whole) in order to record an image of adequate density. A way of achieving this is explained below referring to the case, as an example, where each picture element is expressed with one ink dot by using a definite amount of ink having a definite recording agent concentration. In this case, it is desirable that the ink dot printed in each section corresponding to the picture element (hereinafter this section of the recording media is simply referred to as a "picture element") may spread as uniformly as possible over the entire area of the picture element. The reason for this is as follows: when an ink dot much smaller than the area of each picture element is fixed therein, the picture element density is observed as being low even though the recording density of the ink dot itself is high. On the contrary, when a relatively large ink dot is fixed in each picture element, the density of the picture element is high even though the recording density of the ink dot itself is low, since when the ink dot spreads over the entire area of the picture element, the picture element density becomes the maximum value.

This is because the picture element density depends chiefly on the ratio of the ink dot area therein to the blank area.

When recording media having higher ink-spreading ability are used, recording can be carried out by using picture elements larger in each area and therefore the recording speed can be increased.

Accordingly, it is required, in addition to the above noted requirements, for ink-jet recording media to have such proper ink-spreading ability as to spread an applied ink droplet uniformly over the entire area of each picture element having a predetermined size.

For example, common wood-free paper is poor in ink absorbability, and hence sufficiently large ink dots cannot be obtained thereon, shapes of ink dots are very inferior, and moreover no desired uniform picture element density can be obtained. With commercial non-coated paper, the absorbability of inks is sufficient but ink droplets run along fibers of the paper and therefore the degree of ink-spreading is nonuniform on the paper and the shapes and sizes of ink dots are difficult to control and additionally the density of ink dots may vary locally, so that sufficient picture element density cannot be obtained.

SUMMARY OF THE INVENTION

The invention was made aiming at solving the problems in the field of ink-jet recording that could not be solved according to the prior art, and at satisfying particularly the above noted various requirements in multicolor ink-jet recording employing a plurality of color recording liquids.

An object of the invention is to provide a new ink-jet recording method which can always exhibit good recording characteristics even when recording liquids of water contents covering a wide range are used.

A further object of the invention is to provide a new ink-jet recording system which can always exhibit good recording characteristics even when recording liquids of viscosities covering a wide range are used.

A still further object of the invention is to provide a new ink-jet recording system which can always exhibit good recording characteristics even when recording liquids of surface tensions covering a wide range are used.

The above and other object of the invention are achieved with a recording method for carrying out recording by causing droplets of recording liquid to adhere into a recording medium, where the recording surface of the recording medium is formed with at least a filler and part of a fibrous substrate present mixedly.

DESCRIPTION OF THE PREFERRED EMBODIMENTS

The first type of recording medium used in the recording method of the invention is characterized by the unique structure of the ink-accepting recording surface thereof.

That is, a recording medium used in the invention is composed basically of (1) a substrate comprising mainly a fibrous material and (2) filler particles adhering to the surface of the substrate. The recording surface of this recording medium is in a state where filler particles are very thinly and sparsely deposited on the surface of the substrate so as not to completely hide fibers of the fibrous material which is the main component of the substrate. A typical surface state of the recording medium is shown schematically at 1*b*.

As shown at 1*b*, filler particles 3 are fixed with a binder (not shown) to the surface of the substrate (not shown). Some fibers 2 (hereinafter referred to sometimes as "surface fibers") of the fibrous material which is the main component of the substrate (not shown) are thinly covered in part with filler particles 3 and directly exposed in part to the outside atmosphere. The filler particles 3 not only thinly cover some fibers 2 of the fibrous material, but also are introduced into interstices present among the surface fibers 2. In this way, filler particles 3 that are fixed to parts of surface fillers 2 fill interstices present among the surface fibers 2 such that the shape of the fibers 2 can be perceived at the receiving surface of the recording medium, as a result, parts of the fibers 2 constituting the substrate exist very closely to the recording surface of the recording medium.

Alternatively, fibers of the substrate-constructing fibrous material, at the recording surface, are covered with filler particles uniformly or completely but to such slight degrees that shapes of the fibers may be perceived through the thin layer of filler particles, namely, parts of the fibers are present very closely to the recording surface of the recording medium.

Figure 2:
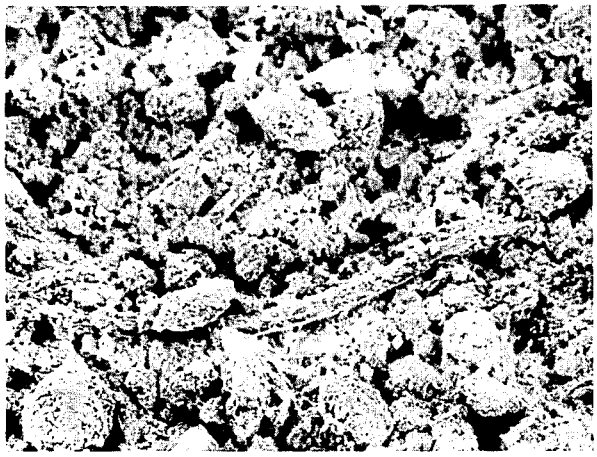
FIG. 2 is a scanning electromicroscopic photograph of magnification 700 which shows filler particles and substrate fibers at the recording surface of a recording medium used in the invention.

FIG. 2 is a scanning electron microscopic photograph of magnification 700 illustrating states of the filler particles and the surface fibers at the recording surface of recording medium used in the invention. This photograph well indicates the characteristic state of the recording surface wherein the filler particles are sparsely fixed at the recording surface to such an extent that superficial parts of the substrate-conducting fibers remain partly uncovered, and parts of the substrate-constructing fibers are present at portions quite near to the recording surface.

Figure 3:
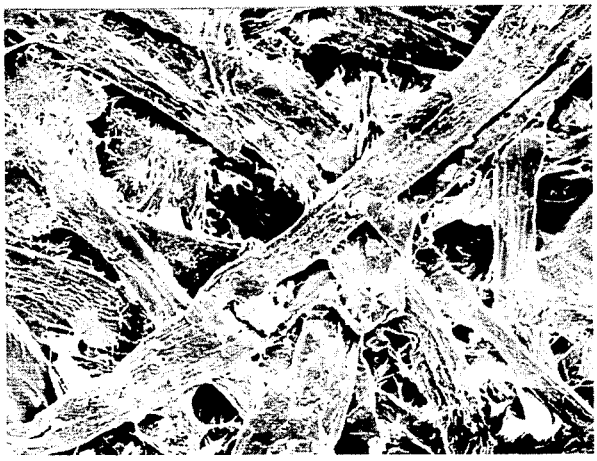
FIG. 3 is a similar photograph showing the recording surface of a conventional ink-jet recording medium.

FIG. 3 is a scanning electron microscopic photograph of magnification 700 showing a part of the recording surface of an existing commercial recording medium (trade name: Ink-Jet Paper L, supplied by Mitsubishi Paper Mills, Ltd.). This photograph well indicates the structure of the recording surface where numerous pulp fibers intertwine. This structure is clearly distinguished from that of the recording medium of the invention.

As described above, the recording surface 1A of this recording medium used in the invention is formed with at least filler particles 3 and some fibers 2 of the substrate-constructing fibrous material present mixedly. When a record is made with an ink on this recording surface 1A, the ink droplets applied thereto are absorbed chiefly in the surface layer composed mainly of filler particles 3 and surface fibers 2 present mixedly and are scarcely absorbed in the inner fiber layer, that is, the ink droplets diffuse little in the depth direction and mostly in the directions parallel to the recording surface. Accordingly, this recording medium used in the invention has an adequate ink-spreading ability and therefore permits fixing a sufficiently large ink dot in each of the above stated picture elements of a predetermined size.

The second type of recording medium used in the recording system of the invention is also characterized by unique structure of the ink-accepting recording surface thereof.

That is, a recording medium used in the invention is composed basically of (1) a substrate consisting mainly of a fibrous material and (2) filler particles deposited very thinly and sparsely on one surface of the substrate. The ink-accepting surface layer is formed with at least the filler particles and parts of the fibers which construct the substrate, present mixedly.

Figure 1:
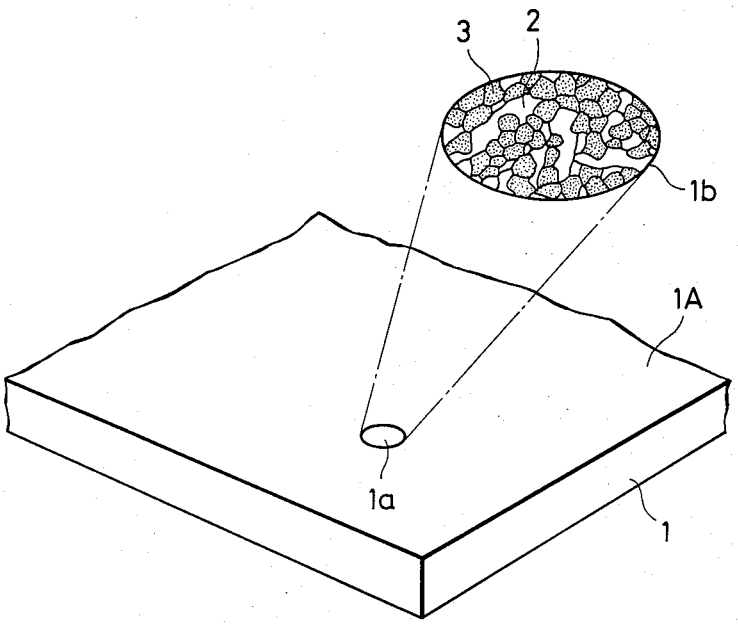
FIG. 1 is a schematic view of a recording medium used in the invention, including a partially enlarged schematic view of the recording surface.
Figure 4:
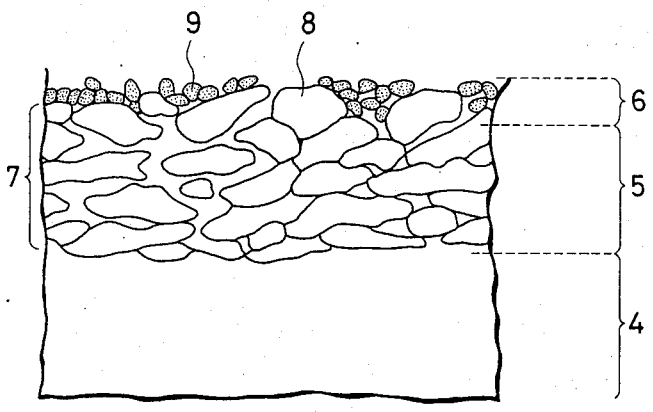
FIG. 4 is a cross-sectional view of a recording medium used in the invention which is taken perpendicularly to the surface of the recording medium.

FIG. 4 shows a schematic cross-sectional view of this recording medium which is taken perpendicularly to the surface of the recording medium.

As shown in FIG. 4, this recording medium used in the invention is composed basically of a top layer 6, middle layer 5, and bottom layer 4. The top layer 6 is constructed of at least filler particles 9 and parts of fibers 8 of a fibrous material which is the main component of a substrate 7, present mixedly. In recording, ink droplets are absorbed chiefly by this top layer 6.

Middle layer 5 lying under the top layer 6 comprises the substrate 7, but filler 9 is not present in middle layer 5. The substrate 7 is mainly constituted of fibers 8. This layer 8 scarcely absorbs inks.

Bottom layer 4 lying under middle layer 5 may be composed of either the same material as that of the substrate 7 in the middle layer 5, or a different material or support.

The filler particles 9 are very thinly and sparsely deposited and fixed chiefly with a binder (not shown) on the upper side of the substrate 7. On the top layer 6, some parts of fibers 8 are thinly covered with filler particles 9 and the other parts of fibers 8 are directly exposed to the outside atmosphere. The filler particles 9 not only thinly cover some parts of fibers 8 but also are introduced into interstices present among fibers 8. Thus the top layer 6 of this type of recording medium used in the invention is constructed of at least filler particles 9 and parts of fibers 8 of the fibrous material which are the main component of the substrate 7, present mixedly.

Figure 5:
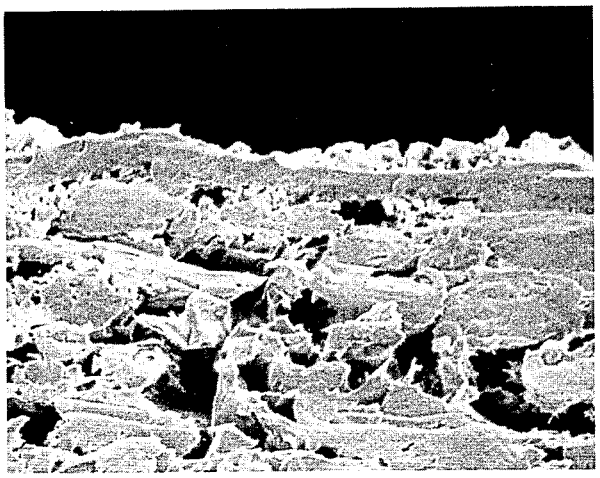
FIG. 5 is a scanning electron microscopic photograph of magnification 1000 showing a cross section of a recording medium used in the invention which is taken perpendicularly to the surface of the recording medium.

FIG. 5 is a scanning electron microscopic photograph of magnification 1000 showing a vertical cross section of the top layer of the recording medium. This photograph well indicates the state of the top layer constructed of chiefly filler particles and parts of fibers of the fibrous material which is the main component of the substrate, present mixedly, the filler particles being very thinly and sparsely deposited and fixed chiefly with a binder (not shown) on the upper side of the substrate.

Figure 6:
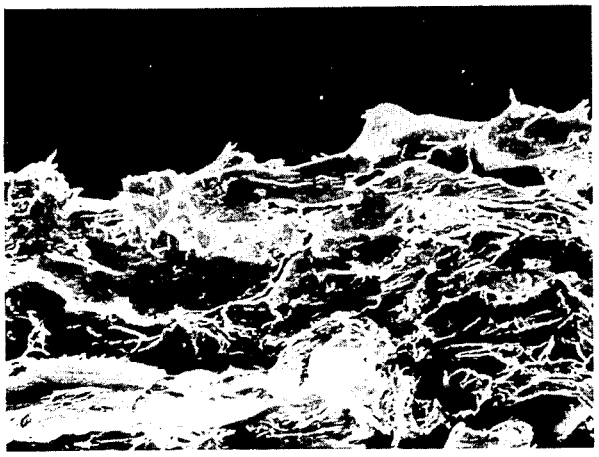
FIG. 6 is a similar photograph of magnification 1000 of a conventional ink-jet recording medium.

FIG. 6 is a scanning electron microscopic photograph of magnification 1000 showing a vertical cross section of the top layer of an existing commercial recording medium (tradename: Ink-jet Paper M, supplied by Mitsubishi Paper Mills, Ltd.). This photograph well indicates the structure of the top layer where numerous pulp fibers overlap one another. This structure is clearly distinguished from that of the top layer of recording medium used in the invention.

When a record is made on this recording medium of the invention with an ink, ink droplets applied to the top layer surface are absorbed chiefly in the top layer 6 composed mainly of parts of fibers 8 and filler particles present mixedly, and are scarcely absorbed in the middle layer 5, that is, the ink droplets diffuse little in the depth direction and mostly in the directions parallel to the recording medium surface.

The reason for this is as follows: The filler particle is smaller in diameter than the fiber and naturally is larger in specific surface area (surface area per unit weight) than the fiber. Ink droplets (recording liquid droplets) are absorbed in the recording medium by the action of the surface energy of the filler particles or the fibers, and absorbed more quickly in the portion composed of a greater number of filler particles which have greater surface energy, i.e. a larger specific surface area, than in the portions composed of fibers.

In the recording medium of the invention, the filler particles are very thinly and sparsely deposited and fixed in the top layer and hence the top layer has a larger specific surface area than the inner layer. Thus the ink diffusion is quicker in the horizontal direction than in the vertical direction on account of the difference in specific surface energy between the top layer and the inner layer. In consequence, the recording medium used in the invention has an adequate ink-spreading ability and permits fixing a sufficiently large ink dot in each of the picture elements of a predetermined size.

While paper is suitable as a substrate mainly composed of a fibrous material for use in the invention, cloth or synthetic paper may also be used. For the purpose of inhibiting the ink diffusion in the depth direction of the recording medium as stated above, it is preferred to use a substrate mainly composed of a fibrous material which has an ink absorbability suppressed by sizing or some other suitable method. The substrate may also be supported by a plastic film or the like.

Another component of the recording surface 1A layer or the top layer 6 of the recording medium used in the invention is a filler 9, as stated above, which is fixed chiefly with a binder on the substrate. Such fillers include, for example, a silica powder, clay, talc, kaolin, diatomaceous earth, calcium carbonate powder, calcium sulfate powder, satin white, aluminum silicate powder, alumina powder, and zeolite powder. These are used alone or in combination.

Particle sizes of the filler are desirably 0.05 to 50 μm, preferably 0.1 to 20 μm, for the purpose of fixing, at the recording surface 1A of the recording medium, filler particles 3 to the substrate fibers such that the fibers 2 constituting the substrate can be still perceived and the interstices present among the fibers are filled with the filler particles, or fixing, at the top layer 6 of the recording medium, filler particles 9 to the substrate such that parts of fibers 8 mainly constituting substrate 7 and filler 9 are present mixedly, so as to give good ink absorbability and ink-spreading ability to the recording surface layer of the recording medium used in the invention. Too large particle sizes of the filler result in nonuniform degrees of ink spread on the recording medium and make it difficult to control the size and shape of ink dots.

When a porous powder is used as the filler, ink droplets attached to the recording surface penetrates into the porous filler and the recording component of the ink (e.g. a dye or a pigment) is adsorbed on and in the porous filler, thereby good coloration being attainable.

Suitable binders for fixing the filler on the substrate surface include water-soluble polymers, e.g. starch, gelatin, casein, gum arabic, sodium alginate, carboxymethylcellulose, polyvinyl alcohol, polyvinylpyrrolidone, polyacrylic acid sodium salt, and polyacrylamide; synthetic rubber latexes; and resins soluble in organic solvents, e.g., polyvinyl butyral polyvinyl chloride, polyvinyl acetate, polyacrylonitrile, polymethyl methacrylate, polyvinyl formal, melamine resin, polyamide, phenol resin, polyurethane, and alkyd resin. Various additives such as other pigments (e.g. plastic pigments), dispersant, fluorescent dye, pH regulator, defoaming agent, lubricant, preservative, and surfactant, together with the above-mentioned filler, can be incorporated into the recording surface layer unless the effect of the invention is impaired.

The recording medium used in the invention can be made by dispersing a mixture composed mainly of the above-cited filler and binder in a medium such as water to prepare a coating liquid, followed by applying the coating liquid on a substrate according to a roll coating method, a rod bar coating method, a spray coating method, or an air-knife coating method, and drying the coat as quickly as possible.

Suitable mixing ratios of the filler to the binder in the coating liquid are generally from 100:10 to 100:150 by weight. When the average particle size of the filler is relatively large, better results are obtained by decreasing the amount of the binder as far as possible. The amount of the coating mixture containing the filler and the binder is determined depending on the quantity of ink for one ink dot and on the desired ink dot diameter corresponding to the size of the picture element in which the ink dot is to be marked. That is, larger ink dots will result from less coating. The coating weight is usually within the range of about 1 to 30 $g/m^2$ (dry coating weight), where the recording surface layer will have a thickness of about 0.5 to 10 $\mu m$.

As described above, the recording medium used in the invention, which has the unique structure of the recording surface or the inside of surface layer, exhibits high ink absorbability and such an adequate ink-spreading ability that the ink droplet spreads uniformly throughout a picture element of the predetermined size, and gives good ink dot shapes, thus affording sufficient picture element density and good coloration.

According to the invention, it has become possible by manipulating the quantity of the coating material in the recording medium to control the ink dot diameter recorded to a desired value adapted to the area of the picture element; moreover, it has become possible to carry out recording with higher picture element density at higher speeds than according to the prior art.

The recording liquid used in the method of the invention is composed of a recording agent such as a dye, and a liquid medium. Generally, it is important for recording to match liquid physical properties such as viscosity and surface tension and the like of the recording liquid to the recording medium. Mixtures of water with various water-miscible organic solvents are used as liquid media for the recording liquid, wherein the water content is adjusted to be within the range of 10 to 90% by weight. When the water content of the recording liquid exceeds 90 weight percent, even the recording medium described above is not satisfactory since it does not have sufficient affinity to the surface of the recording medium, resulting a lower absorbability of the recording liquid to give longer fixing time required therefor and limited recording speed, and further the overlapping of the recorded dots of different color recording liquid causes mixing of color or unwanted spreading or disorder of the ink dots.

Such a recording liquid involves additional problems in its discharge-stability and the solution-stability of recording agent, hence being unsuitable. When the water content in the recording liquid is less than 10% by weight, the coloration, the spreading degree, and the dot shape of ink will be unsatisfactory even with the above described recording media.

Further, it is necessary to choose recording liquids having a high ability to wet the recording medium. Since the critical surface tensions of the above described recording media are in the range of 40 to 50 dyne/cm, it is preferable to use recording liquids having surface tensions in or around the above range. Accordingly, recording liquids used in the system of the invention need to have surface tensions of 30 to 60 dyne/cm, preferably 35 to 55 dyne/cm, and most preferably 40 to 50 dyne/cm, at 20° C. When a recording liquid having a surface tension lower than the above lower limit is used for recording, the wettability of the recording medium will be high but the spread of printed dots will be too large. On the contrary, when a recording liquid having a surface tension higher than the above upper limit is used, the wettability of the recording medium will be inferior, thus lowering the absorbability of ink droplets and the density of ink dots.

For the recording liquid used in the method of the invention, water alone or preferably a mixture of water and a water-miscible organic solvent may be used provided that the above requirements for the surface tension of recording liquids is satisfied.

On the other hand, the ink absorption speed is in approximately inverse proportion to the viscosity of the ink. Further, with an increase in the viscosity of ink, the diameter of the ink droplet tends to decrease and the diameter of the printed dot also tends to decrease. Such printing characteristics vary depending upon the structure and construction materials of the recording medium. In consequence, it is important to match liquid physical properties of the recording liquid to the recording medium.

Water alone or, desirably, combination of water and a water-miscible organic solvent is used as a medium for the recording liquid in the method of the invention so that the viscosity of the recording liquid at 25° C. will not exceed 20 cp (centipoise), preferably 15 cp, and most preferably 12 cp. If the viscosity at 25° C. exceeds 20 cp, the absorbability of the recording liquid to the recording medium will be too low, and therefore a prolonged time will be required for fixing, the recording speed will be limited, ink droplets of different colors, when overlapping one another at the recording surface, will mix together, and unnecessary enlargement or disorder of ink dots will occur.

Suitable water-miscible organic solvents for use as component media of recording liquids include; alcohols of $C_1$–$C_4$ alkyls, e.g. methanol, ethanol, n-propanol, isopropanol, n-butanol, sec-butanol, tert-butanol, and isobutanol; amides, e.g. dimethylformamide and dimethylacetamide; ketones or ketoalcohols, e.g. acetone or diacetone alcohol; ethers, e.g. tetrahydrofuran and dioxane; polyalkylene glycols, e.g. polyethylene glycol and polypropylene glycol; alkylene glycols having 2–6 carbon atoms in the alkylene group, e.g. ethylene glycol, propylene glycol, 1,2,6-hexanetriol, thiodiglycol, hexylene glycol, and diethylene glycol; and lower alkyl ethers of polyhydric alcohols, e.g. glycerol, ethylene glycol methyl ether, diethylene glycol methyl (or ethyl) ether, and triethylene glycol monomethyl (or monoethyl) ether. Of these water-miscible organic solvents, preferred are polyhydric alcohols such as diethylene glycol and lower alkyl ethers of polyhydric alcohols, such as triethylene glycohol monomethyl (or monoethyl) ether. Polyhydric alcohols are particularly preferred since they act good wetting agents for preventing the clogging of nozzles which may be caused by evaporation of water from the recording liquid, and by deposition of the recording agent.

A solubilizating agent also may be added to the recording liquid. Typical solubilizating agents are nitrogen-containing heterocyclic ketones. The intention of the solubilization agent is to improve greatly the solubility of the recording colorant to the solvent. For example, N-methyl-2-pyrrolidone and 1,3-dimethyl-2-imidazolidinone are preferably used.

The recording liquid containing the above-mentioned components is superior per se in recording characteristics (signal responsiveness, stability of droplet formation, discharge stability, long-term continuous recording workability, discharge stability after a long rest, etc.), storage stability, and fixability in recording media. Various additives may be incorporated into the recording liquid for the purpose of further improving characteristics mentioned above. Such additives include; viscosity modifiers, e.g. polyvinyl alcohol, cellulosic resins, and other water-soluble resins; various surfactants of cationic, anionic, and nonionic types; surface tension modifiers, e.g. diethanolamine and triethanolamine; and buffers for pH conditioning.

When the recording liquid is used in an ink-jet recording process which comprises electrification of the recording liquid, an inorganic salt such as lithium chloride, ammonium chloride, or sodium chloride is added as a resistivity modifier to the recording liquid. When the recording liquid is used in an ink-jet recording process which comprises discharging the recording liquid by the action of thermal energy, thermal physical properties, e.g. specific heat, coefficient of thermal expansion, and heat conductivity, of the recording liquid are conditioned if necessary.

According to the recording method of the invention, a clear image of excellent color is produced without flowing-out or blotting-out of recording liquids, even when the recording liquids of different colors are overlaid in one spot within a short time interval. In addition, these favorable results can invariably be obtained even with a wide variety of inks chosen according to the ink discharging method and the purpose of recording. Thus, the recording system of the invention is excellent as a color ink-jet recording method.

The invention is illustrated in more detail with reference to the following examples. In these examples, parts are all by weight.

EXAMPLE 1

A coating composition was prepared according to the following recipe by using precipitated calcium carbonate (average particle size 1 μm) as a filler and polyvinyl alcohol and an SBR latex as binders.

Recipe:
Precipitated calcium carbonate—100 parts
Polyvinyl alcohol—25 parts
SBR latex—5 parts
Water—500 parts Then, using wood-free paper (basis weight 65 g/m$^2$) having a sizing degree of 35 sec, as measured in accordance with JIS P-8122, as a fibrous substrate, the above coating composition was applied on the paper according to a blade coating method so as to give a dry coating weight of 2 g/m$^2$, and dried in the ordinary way, giving a recording medium. A scanning electron microscopic photograph (magnification factor 700) of the recording surface of this recording medium is shown in FIG. 2.

Using the following inks, a color ink-jet recording test of this recording medium was made under the recording conditions of droplet diameter 90 μm and picture element size 300×300 μm to evaluate recording characteristics of the recording medium.

Ink No. A: water content about 90 wt%
Composition:
Glycerol—8 parts
Water—90 parts
C.I. Direct Blue 86—2 parts Ink No. B: water content about 70 wt%
Composition:
Glycerol—28 parts
Water—70 parts
C.I. Direct Blue 86—2 parts Ink No. C: water content about 50 wt%
Composition:
Ethylene glycol—48 parts
Water—50 parts
C.I. Direct Blue 86—2 parts Ink No. D: water content about 30 wt%
Composition:
Diethylene glycol—20 parts
N-Methyl-2-pyrrolidone—20 parts
Ethyl cellosolve—28 parts
Water—30 parts
C.I. Direct Blue 86—2 parts Ink No. E: water content about 20 wt%
Composition:
Diethylene glycol—10 parts
N-Methyl-2-pyrrolidone—30 parts
Ethyl Cellosolve—38 parts
Water—20 parts
C.I. Direct Blue 86 2 parts Ink No. F: water content about 10 wt%
Composition:
Diethylene glycol—10 parts
N-Methyl-2-pyrrolidone—40 parts
Ethyl Cellosolve—38 parts
Water—10 parts
C.I. Direct Blue 86—2 parts Results of the recording characteristic evaluation of the recording media are shown in Table 1. The manner and criteria of the evaluation were as follows:

(1) Density of picture element: Reflective optical density when all the picture elements were marked with ink dots was measured by using a photographic densitomer NLM-STD-Tr (supplied by Narumi Shohkai).
(2) Shape of ink dot: Ink dots were observed with a stereomicroscope, and the shapes nearly circular were marked with o, those somewhat distorted circular with Δ, and those irregular with x.
(3) Degree of ink spread: Diameters of ink dots were measured with a stereomicroscope, and the ratio of diameters of printing dots to diameters of ink droplets was shown as the degree of ink spread.
(4) Clearness of color: The clearness of ink-jet recording image color was evaluated by visual observation, and the results were compared and ranked as follows:
◎: best, o: better, Δ: worse, x: worst.
(5) Ink absorbability: Three ink dots were superposed at the recording surface, and after 1 sec, the state of ink there was observed and rated as follows:
The state where no ink elution was observed and the image was distinct was marked with o and other states with x.

EXAMPLE 2

A coating composition was prepared according to the following recipe by using silica powder (trade name: Nipsil E 220A, supplied by Nihon Silica Industries Co., Ltd., average particle size 1.0 μm) as a filler, and starch and SBR latex as binders.

Recipe:
Silica powder—100 parts
Starch—30 parts
SBR latex—10 parts
Water—300 parts This coating composition was applied on a fibrous substrate (the same wood-free paper as used in Example 1) according to a blade coating method so as to give a dry coating weight of 2 g/m$^2$, and dried in a conventional manner, giving a recording medium.

The recording surface of this recording medium shown by a scanning electron microscopic photograph (magnification factor 700) was nearly the same in appearance as that of Example 1 shown by FIG. 2.

Recording on this recording medium was conducted in the same manner as in Example 1, to evaluate recording characteristics of the recording medium. Results of the evaluation are shown in Table 2.

EXAMPLE 3

A coating composition was prepared according to the following recipe by using kaolin (average particle size 2 μm) as a filler and casein as a binder.

Recipe:
Kaolin—100 parts
Casein—20 parts
Water—500 parts

Then this coating composition was applied on a fibrous substrate (the same wood-free paper as used in Example 1) according to a blade coating method so as to give a dry coating weight of 5 g/m$^2$, and dried in, giving a recording medium.

The recording surface of this recording medium shown by a scanning electron microscopic photograph (magnification factor 700) was nearly the same in appearance as that of Example 1 shown in FIG. 2.

Recording characteristics of this recording medium were evaluated in the same manner as in Example 1. Results of the evaluation are shown in Table 3.

Comparative Example 1

Recording characteristics of a commercial ink-jet recording paper (trade name: Ink-Jet Paper L, supplied by Mitsubishi Paper Mills, Ltd.) were evaluated in the same manner as in Example 1. Results of the evaluation are shown in Table 3 and the recording surface of this ink-jet recording paper is shown by a scanning electron microscopic photograph (magnification factor 700) of FIG. 3.

Comparative Example 2

Recording characteristics of a commercial art paper (trade name; SK Coat, supplied by Sanyo Kokusaku Pulp Co., Ltd.) were evaluated in the same manner as in Example 1. Results thereof are shown in Table 5.

EXAMPLE 4

A coating composition was prepared according to the following recipe by using calcium carbonate powder (average particle size 1 μm) as a filler, and starch and an SBR latex as binder.

Recipe:
Calcium carbonate—100 parts
Starch—30 parts
SBR latex—10 parts
Water—300 parts This coating composition was applied on a fibrous substrate (the same common wood-free paper as used in Example 1) according to a blade coating method so as to give a dry coating weight of 3 g/m$^2$, and dried in a conventional manner, giving a recording medium. FIG. 5 shows a scanning electron microscopic photograph (magnification factor 1000) of a depth-directional cross section of this recording medium.

Recording characteristics of this recording medium were evaluated in the same manner as in Example 1. Results thereof are shown in Table 6.

EXAMPLE 5

A coating composition was prepared according to the following recipe by using a silica powder (the same as used in Example 2) as a filler, and polyvinyl alcohol and an SRB latex as binders.

Recipe:
Silica powder—100 parts
Polyvinyl alcohol—25 parts
SBR latex—5 parts
Water—500 parts This coating composition was applied on a fibrous substrate (the same wood-free paper as used in Example 1) according to a blade coating method so as to give a dry coating weight of 2 g/m$^2$, and dried in a conventional manner giving a recording medium.

A scanning electron microscopic photograph (magnification factor 1000) of a depth-directional cross section of this recording medium was nearly identical in appearance with that of Example 4 shown by FIG. 5.

Recording characteristics of this recording medium were evaluated in the same manner as in Example 4. Results thereof are shown in Table 7.

EXAMPLE 6

A coating composition was prepared according to the following recipe by using a talc powder (average particle size 2 μm) and casein as a binder.

Recipe:
Talc 100 parts
Casein 20 parts
Water 500 parts

This coating composition was applied on a fibrous substrate (the same common wood-free paper as used in Example 1) according to a blade coating method so as to give a dry coating weight of 2 g/m$^2$, and dried in the ordinary way, giving a recording medium.

A scanning electron microscopic photograph (magnification factor 1000) of a depth-directional cross section of this recording medium was nearly the same in appearance as that of Example 4 shown by FIG. 5.

Recording characteristics of this recording medium were evaluated in the same manner as in Example 4. Results thereof are shown in Table 8.

Comparative Example 3

Recording characteristics of a commercial ink-jet recording paper (trade name: Ink-Jet Paper M, supplied by Mitsubishi Paper Mills, Ltd.) were evaluated in the same manner as in Example 1. Results thereof are shown in Table 9. FIG. 6 shows a scanning electron microscopic photograph (magnification factor 1000) of a depth-directional cross section of this ink-jet recording paper.

Comparative Example 4

Recording characteristics of a commercial art paper (trade name: SK Coat, supplied by Sanyo Kokusaku Pulp Co., Ltd.) were evaluated in the same manner as in Example 1. Results thereof are shown in Table 10.

EXAMPLE 7

Using the following inks, a color ink-jet recording test on the recording medium prepared in Example 1 was made under the recording conditions of droplet diameter 90 μm and picture element size 300×300 μm to evaluate recording characteristics of the recording medium.

Ink No. G: surface tension about 60 dyne/cm
Composition:
Ethylene glycol—30 parts
Water—70 parts
C.I. Direct Blue 86—2 parts Ink No. H: surface tension about 55 dyne/cm
Composition:
Ethylene glycol—30 parts
Water—70 parts
Acetynol EH (10% aq.) (trade name of a surfactant, supplied by Kawaken Fine Chemicals Co., Ltd.)—0.05 parts
C.I. Direct Blue 86—2 parts Ink. No. I: surface tension about 50 dyne/cm
Composition:
Ethylene glycol—30 parts
Water—70 parts
Acetynol EH (10% aq.)—0.07 parts
C.I. Direct Blue 86—2 parts Ink No. J: surface tension about 45 dyne/cm
Composition:
Ethylene glycol—30 parts
Water—70 parts
Acetynol EH (10% aq.)—0.5 parts
C.I. Direct Blue 86—2 parts Ink No. K: surface tension about 40 dyne/cm
Composition:
Diethylene glycol—30 parts
Water—70 parts
Acetynol EH (10% aq.)—1.1 parts
C.I. Direct Blue 86—2 parts Ink No. L: surface tension about 35 dyne/cm
Composition:
Propylene glycol monoethyl ether—30 parts
Water—70 parts
Acetynol EH (10% aq.)—1.0 part
C.I. Direct Blue 86—2 parts Ink No. M: surface tension about 30 dyne/cm
Composition:
Propylene glycol monoethyl ether—30 parts
Water—50 parts
Acetynol EH (10% aq.)—0.1 parts
C.I. Direct blue 86—2 parts Results of the recording characteristic evaluation are shown in Table 11. The way and criteria of the evaluation were as follows:

(1) Density of picture element: Reflective optical density when all the picture elements were marked with ink dots was measured by using a photographic densitometer MLM-STD-Tr (supplied by Narumi Shohkai).
(2) Shape of ink dot: Ink dots were observed with a stereomicroscope, and the shapes nearly circular were marked with o, those somewhat distorted circular with Δ, and those irregular with x.
(3) Degree of ink spread: Diameters of ink dots were measured with a stereomicroscope, and the ratio of diameters of printing dots to the diameter of ink droplets was shown as the degree of ink spread.
(4) Clearness of color: The clearness of ink-jet recording image color was evaluated by visual observation, and the results were compared and ranked as follows: ◎: best, o: better, Δ: worse, x: worst.
(5) Ink absorbability: Two different-color ink dots were superposed at the recording surface and then the state of ink there was observed and rated as follows: The state of no ink flow-out observed and image being distinct was marked with o and other states with x.

EXAMPLE 8

In the same manner as in Example 7, a color ink-jet recording test on the recording medium prepared in Example 2 was made to evalute recording characteristics thereof. Results of the evaluation are shown in Table 12.

EXAMPLE 9

In the same manner as in Example 7, a color ink-jet recording test on the recording medium prepared in Example 3 was made to evaluate recording characteristics thereof. Results of the evaluation are shown in Table 13.

Comparative Example 5

In the same manner as in Example 7, a color ink-jet recording test on the same recording medium as tested in Comparative Example 1 was made to evaluate recording characteristics thereof. Results of the evaluation are shown in Table 14.

Comparative Example 6

In the same manner as in Example 7, a color ink-jet recording test on the same recording medium as tested in Comparative Example 2 was made to evaluate recording characteristics thereof. Results of the evaluation are shown in Table 15.

EXAMPLE 10

In the same manner as in Example 7, a color ink-jet recording test on the recording medium prepared in Example 4 was made to evaluate recording characteristics thereof. Results of the evaluation are shown in Table 16.

EXAMPLE 11

In the same manner as in Example 7, a color ink-jet recording test on the recording medium prepared in Example 5 was made to evaluate recording characteristics thereof. Results of the evaluation are shown in Table 17.

EXAMPLE 12

In the same manner as in Example 7, a color ink-jet recording test on the recording medium prepared in Example 6 was made to evaluate recording characteristics thereof. Results of the evaluation are shown in Table 18.

Comparative Example 7

In the same manner as in Example 7, a color ink-jet recording test on the same recording medium as tested in Comparative Example 3 was made to evaluate recording characteristics thereof. Results of the evaluation are shown in Table 19.

Comparative Example 8

In the same manner as in Example 7, a color ink-jet recording test on the same recording medium as tested in Comparative Example 4 was made to evaluate recording characteristics thereof. Results of the evaluation are shown in Table 20.

EXAMPLE 13

Using the following inks, a color ink-jet recording test on the same recording medium prepared in Example 1 was made under the recording conditions of droplet diameter 90 μm and picture element size 300×300 μm to evaluate the recording characteristics of the recording medium.

Ink. No. N: viscosity about 20 cp
Composition:
Glycerol—65 parts
Water—35 parts
Acetynol EH (trade name of a surfactant supplied by Kawaken Fine Chemicals Co., Ltd.)—0.1 parts
C.I. Direct Blue 86—2 parts Ink No. O: viscosity about 15 cp
Composition:
Diethylene glycol—80 parts
Water—20 parts
Acetynol EH (10% aq.)—0.1 parts
C.I. Direct Blue 86—2 parts Ink No. P: viscosity about 10 cp
Composition:
Diethylene glycol—70 parts
Water—30 parts
Acetynol EH (10% aq.)—0.1 parts
C.I. Direct Blue 86—2 parts Ink No. Q: viscosity about 5 cp
Composition:
Triethylene glycol monomethyl ether—50 parts
Water—50 parts
Acetynol EH—0.1 parts
C.I. Direct Blue 86—'parts Ink. No. R: viscosity about 3 cp
Composition:
Ethylene glycol—45 parts
Water—55 parts
Acetynol—0.1 parts
C.I. Direct Blue 86—2 parts Ink No. S: viscosity about 1.5 cp
Composition:
Ethylene glycol—70 parts
Water—30 parts
Acetynol EH—0.1 parts
C.I. Direct Blue 86—2 parts Results of the recording characteristic evaluation are shown in Table 21. The evaluation of recording characteristics was made in the same manner and according to the same criteria as in Example 7.

EXAMPLE 14

In the same manner as in Example 13, a color ink-jet recording test on the recording medium prepared in Example 2 was made to evaluate the recording characteristics thereof. Results of the evaluation are shown in Table 22.

EXAMPLE 15

In the same manner as in Example 13, a color ink-jet recording test on the recording medium prepared in Example 3 was made to evaluate recording characteristics thereof. Results of the evaluation are shown in Table 23.

Comparative Example 9

In the same manner as in Example 13, a color ink-jet recording test on the same recording medium as tested in Comparative Example 1 was made to evaluate recording characteristics thereof. Results of the evaluation are shown in Table 24.

Comparative Example 10

In the same manner as in Example 13, a color ink-jet recording test on the same recording medium as tested in Comparative Example 2 was made to evaluate recording characteristics thereof. Results of the evaluation are shown in Table 25.

EXAMPLE 16

Color ink-jet recording tests, using papers of Example 13 and Comparative Examples 9 and 10 as a recording medium, were made to evaluate recording characteristics thereof, in the same manner as in Example 7 but using only ink No. Q at ambient temperatures of 5°, 25°, and 40° C. Results thereof are shown in Table 26.

EXAMPLE 17

In the same manner as in Example 13, a color ink-jet recording test on the recording medium prepared in Example 4 was made to evaluate the recording characteristics thereof. Results of the evaluation are shown in Table 27.

EXAMPLE 18

In the same manner as in Example 13, a color ink-jet recording test on the recording medium prepared in Example 5 was made to evaluate the recording characteristics thereof recording medium. Results thereof are shown in Table 28.

EXAMPLE 19

In the same manner as in Example 13, a color ink-jet recording test on the recording medium prepared in Example 6 was made to evaluate the recording characteristics thereof. Results of the evaluation are shown in Table 29.

Comparative Example 11

In the same manner as in Example 13, a color ink-jet recording test on the same recording medium as tested in Comparative Example 3 was made to evaluate the recording characteristics thereof. Results of the evaluation are shown in Table 30.

Comparative Example 12

In the same manner as in Example 13, a color ink-jet recording test on the same recording medium as tested in Comparative Example 4 was made to evaluate the recording characteristics thereof. Results of the evaluation are shown in Table 31.

EXAMPLE 20

In the same manner as in Example 16, color ink-jet recording tests, using papers of Example 17 and Comparative Examples 11 and 12 as a recording medium, were made to evaluate the recording characteristics thereof. Results of the evaluation are shown in Table 32.

TABLE 1

| Evaluation item | Ink No. A | B | C | D | E | F |
|---|---|---|---|---|---|---|
| | Water content 90 | 70 | 50 | 30 | 20 | 10 |
| Density of picture element | 0.75 | 0.75 | 0.76 | 0.77 | 0.77 | 0.79 |
| Shape of ink dot | ○ | ○ | ○ | ○ | ○ | ○ |
| Degree of ink spread | 4.4 | 4.5 | 4.5 | 4.7 | 4.9 | 5.0 |
| Clearness of image color | ○ | ○ | ○ | ○ | ○ | ○ |
| Ink absorbability | ○ | ○ | ○ | ○ | ○ | ○ |

TABLE 2

| Evaluation item | Ink No. A | B | C | D | E | F |
|---|---|---|---|---|---|---|
| | Water content 90 | 70 | 50 | 30 | 20 | 10 |
| Density of picture element | 0.64 | 0.64 | 0.63 | 0.63 | 0.63 | 0.62 |
| Shape of ink dot | ○ | ○ | ○ | ○ | ○ | ○ |
| Degree of ink spread | 4.3 | 4.3 | 4.3 | 4.4 | 4.6 | 4.8 |
| Clearness of image color | ◎ | ◎ | ◎ | ◎ | ◎ | ◎ |
| Ink absorbability | ○ | ○ | ○ | ○ | ○ | ○ |

TABLE 3

| Evaluation item | Ink No. A | B | C | D | E | F |
|---|---|---|---|---|---|---|
| | Water content 90 | 70 | 50 | 30 | 20 | 10 |
| Density of picture element | 0.51 | 0.53 | 0.54 | 0.54 | 0.55 | 0.55 |
| Shape of ink dot | ○ | ○ | ○ | ○ | ○ | ○ |
| Degree of ink spread | 3.8 | 3.7 | 3.7 | 3.8 | 4.0 | 4.1 |
| Clearness of image color | Δ | ○ | ○ | ○ | ○ | ○ |
| Ink absorbability | ○ | ○ | ○ | ○ | ○ | ○ |

TABLE 4

| Evaluation item | Ink No. A | B | C | D | E | F |
|---|---|---|---|---|---|---|
| | Water content 90 | 70 | 50 | 30 | 20 | 10 |
| Density of picture element | 0.33 | 0.34 | 0.35 | 0.35 | 0.35 | 0.36 |
| Shape of ink dot | × | × | × | × | × | × |
| Degree of ink spread | 3.5 | 3.5 | 3.6 | 3.9 | 4.0 | 4.2 |
| Clearness of image color | Δ | Δ | Δ | Δ | Δ | Δ |
| Ink absorbability | ○ | ○ | ○ | ○ | ○ | ○ |

TABLE 5

| Evaluation item | Ink No. A | B | C | D | E | F |
|---|---|---|---|---|---|---|
| | Water content 90 | 70 | 50 | 30 | 20 | 10 |
| Density of Picture element | 0.30 | 0.32 | 0.34 | 0.35 | 0.35 | 0.35 |
| Shape of ink dot | ○ | ○ | ○ | ○ | ○ | ○ |
| Degree of ink spread | 3.5 | 3.5 | 3.5 | 3.7 | 3.9 | 4.1 |
| Clearness of image color | Δ | Δ | Δ | Δ | Δ | Δ |
| Ink absorbability | × | × | × | × | × | × |

TABLE 6

| Evaluation item | Ink No. A | B | C | D | E | F |
|---|---|---|---|---|---|---|
| | Water content wt % 90 | 70 | 50 | 30 | 20 | 10 |
| Density of picture element | 0.46 | 0.47 | 0.46 | 0.46 | 0.47 | 0.48 |
| Shape of ink dot | ○ | ○ | ○ | ○ | ○ | ○ |
| Degree of ink spread | 3.6 | 3.7 | 3.6 | 3.7 | 3.7 | 3.8 |
| Clearness of image color | ○ | ○ | ○ | ○ | ○ | ○ |
| Ink absorbability | ○ | ○ | ○ | ○ | ○ | ○ |

TABLE 7

| Evaluation item | Ink No. A | B | C | D | E | F |
|---|---|---|---|---|---|---|
| | Water content wt % 90 | 70 | 50 | 30 | 20 | 10 |
| Density of picture element | 0.67 | 0.68 | 0.67 | 0.66 | 0.68 | 0.67 |
| Shape of ink dot | ○ | ○ | ○ | ○ | ○ | ○ |
| Degree of ink spread | 4.6 | 4.6 | 4.6 | 4.7 | 4.9 | 5.1 |
| Clearness of image color | ◎ | ◎ | ◎ | ◎ | ◎ | ◎ |
| Ink absorbability | ○ | ○ | ○ | ○ | ○ | ○ |

TABLE 8

| Evaluation item | Ink No. A | B | C | D | E | F |
|---|---|---|---|---|---|---|
| | Water content wt % 90 | 70 | 50 | 30 | 20 | 10 |
| Density of picture element | 0.60 | 0.61 | 0.62 | 0.64 | 0.64 | 0.64 |
| Shape of ink dot | ○ | ○ | ○ | ○ | ○ | ○ |
| Degree of ink spread | 4.4 | 4.5 | 4.5 | 4.7 | 4.8 | 4.8 |
| Clearness of image color | ○ | ○ | ○ | ○ | ○ | ○ |
| Ink absorbability | ○ | ○ | ○ | ○ | ○ | ○ |

TABLE 9

| Evaluation item | Ink No. A | B | C | D | E | F |
|---|---|---|---|---|---|---|
| | Water content wt % 90 | 70 | 50 | 30 | 20 | 10 |
| Density of picture element | 0.33 | 0.34 | 0.35 | 0.35 | 0.35 | 0.35 |
| Shape of ink dot | × | × | × | × | × | × |
| Degree of ink spread | 3.5 | 3.5 | 3.6 | 3.9 | 4.0 | 4.2 |
| Clearness of image color | Δ | Δ | Δ | Δ | Δ | Δ |
| Ink absorbability | ○ | ○ | ○ | ○ | ○ | ○ |

TABLE 10

| Evaluation item | Ink No. A | B | C | D | E | F |
|---|---|---|---|---|---|---|
| | Water content wt % 90 | 70 | 50 | 30 | 20 | 10 |
| Density of picture element | 0.30 | 0.32 | 0.34 | 0.35 | 0.35 | 0.35 |
| Shape of ink dot | ○ | ○ | ○ | ○ | ○ | ○ |
| Degree of ink spread | 3.5 | 3.5 | 3.5 | 3.7 | 3.9 | 4.1 |
| Clearness of image color | Δ | Δ | Δ | Δ | Δ | Δ |
| Ink absorbability | × | × | × | × | × | × |

TABLE 11

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.75 | 0.77 | 0.77 | 0.77 | 0.78 | 0.78 | 0.78 |
| Shape of ink dot | ○ | ○ | ○ | ○ | ○ | ○ | Δ |
| Degree of ink spread | 4.3 | 4.4 | 4.5 | 4.5 | 4.5 | 4.8 | 5.0 |
| Clearness of image color | ○ | ○ | ○ | ○ | ○ | ○ | ○ |
| Ink absorbability | ○ | ○ | ○ | ○ | ○ | ○ | ○ |

TABLE 12

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.60 | 0.62 | 0.62 | 0.63 | 0.63 | 0.64 | 0.64 |
| Shape of ink dot | ○ | ○ | ○ | ○ | ○ | ○ | Δ |
| Degree of ink spread | 4.1 | 4.2 | 4.3 | 4.3 | 4.3 | 4.6 | 4.8 |
| Clearness of image color | ◎ | ◎ | ◎ | ◎ | ◎ | ◎ | ◎ |
| Ink absorbability | ○ | ○ | ○ | ○ | ○ | ○ | ○ |

TABLE 13

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.51 | 0.53 | 0.53 | 0.53 | 0.54 | 0.54 | 0.56 |
| Shape of ink dot | ○ | ○ | ○ | ○ | ○ | ○ | ○ |
| Degree of ink spread | 3.6 | 3.6 | 3.8 | 3.8 | 3.8 | 3.9 | 4.2 |
| Clearness of image color | Δ | ○ | ○ | ○ | ○ | ○ | ○ |
| Ink absorbability | ○ | ○ | ○ | ○ | ○ | ○ | ○ |

TABLE 14

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.30 | 0.32 | 0.35 | 0.35 | 0.35 | 0.37 | 0.38 |
| Shape of ink dot | × | × | × | × | × | × | × |
| Degree of ink spread | 3.0 | 3.2 | 3.5 | 3.5 | 3.5 | 3.7 | 4.0 |
| Clearness of image color | Δ | Δ | Δ | Δ | Δ | Δ | Δ |
| Ink absorbability | ○ | ○ | ○ | ○ | ○ | ○ | ○ |

TABLE 15

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.31 | 0.33 | 0.33 | 0.33 | 0.34 | 0.35 | 0.36 |
| Shape of ink dot | ○ | ○ | ○ | ○ | ○ | ○ | Δ |
| Degree of ink spread | 3.3 | 3.4 | 3.6 | 3.6 | 3.6 | 3.7 | 4.0 |
| Clearness of image color | Δ | Δ | Δ | Δ | Δ | Δ | Δ |
| Ink absorbability | × | × | × | × | × | × | × |

TABLE 16

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.45 | 0.47 | 0.47 | 0.47 | 0.48 | 0.48 | 0.48 |
| Shape of ink dot | ○ | ○ | ○ | ○ | ○ | ○ | Δ |
| Degree of ink spread | 3.5 | 3.6 | 3.7 | 3.7 | 3.7 | 4.0 | 4.2 |
| Clearness of image color | ○ | ○ | ○ | ○ | ○ | ○ | ○ |
| Ink absorbability | ○ | ○ | ○ | ○ | ○ | ○ | ○ |

TABLE 17

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.65 | 0.67 | 0.67 | 0.68 | 0.68 | 0.69 | 0.69 |
| Shape of ink dot | ○ | ○ | ○ | ○ | ○ | ○ | Δ |
| Degree of ink spread | 4.5 | 4.6 | 4.7 | 4.7 | 4.7 | 5.0 | 5.2 |
| Clearness of image color | ◎ | ◎ | ◎ | ◎ | ◎ | ◎ | ○ |
| Ink absorbability | ○ | ○ | ○ | ○ | ○ | ○ | ○ |

TABLE 18

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.55 | 0.53 | 0.52 | 0.50 | 0.50 | 0.49 | 0.66 |
| Shape of ink dot | ○ | ○ | ○ | ○ | ○ | ○ | Δ |
| Degree of ink spread | 4.3 | 4.4 | 4.6 | 4.6 | 4.6 | 4.7 | 5.0 |
| Clearness of image color | Δ | ○ | ○ | ○ | ○ | ○ | ○ |
| Ink absorbability | ○ | ○ | ○ | ○ | ○ | ○ | ○ |

TABLE 19

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.30 | 0.32 | 0.35 | 0.35 | 0.35 | 0.37 | 0.38 |
| Shape of ink dot | × | × | × | × | × | × | × |
| Degree of ink spread | 3.0 | 3.2 | 3.5 | 3.5 | 3.5 | 3.7 | 4.0 |
| Clearness of image color | Δ | Δ | Δ | Δ | Δ | Δ | Δ |
| Ink absorbability | ○ | ○ | ○ | ○ | ○ | ○ | ○ |

TABLE 20

| Evaluation item | Ink No. G | H | I | J | K | L | M |
|---|---|---|---|---|---|---|---|
| | Surface tension 60 | 55 | 50 | 45 | 40 | 35 | 30 |
| Density of picture element | 0.31 | 0.33 | 0.33 | 0.33 | 0.34 | 0.35 | 0.36 |
| Shape of ink dot | ○ | ○ | ○ | ○ | ○ | ○ | Δ |
| Degree of ink spread | 3.3 | 3.4 | 3.6 | 3.6 | 3.6 | 3.7 | 4.0 |
| Clearness of image color | Δ | Δ | Δ | Δ | Δ | Δ | Δ |
| Ink absorbability | × | × | × | × | × | × | × |

TABLE 21

| Evaluation item | Ink No. N | O | P | Q | R | S |
|---|---|---|---|---|---|---|
| | Viscosity 20 | 15 | 10 | 5 | 3 | 1.5 |
| Density of picture element | 0.75 | 0.75 | 0.74 | 0.72 | 0.72 | 0.71 |
| Shape of ink dot | ○ | ○ | ○ | ○ | ○ | ○ |
| Degree of ink spread | 4.6 | 4.5 | 4.4 | 4.4 | 4.4 | 4.4 |
| Clearness of image color | ○ | ○ | ○ | ○ | ○ | ○ |
| Ink absorbability | ○ | ○ | ○ | ○ | ○ | ○ |

TABLE 22

| Evaluation item | Ink No. N | O | P | Q | R | S |
|---|---|---|---|---|---|---|
| | Viscosity 20 | 15 | 10 | 5 | 3 | 1.5 |
| Density of picture element | 0.75 | 0.75 | 0.74 | 0.72 | 0.72 | 0.71 |
| Shape of ink dot | ○ | ○ | ○ | ○ | ○ | ○ |
| Degree of ink spread | 4.6 | 4.5 | 4.4 | 4.4 | 4.4 | 4.4 |
| Clearness of image color | ○ | ○ | ○ | ○ | ○ | ○ |
| Ink absorbability | ○ | ○ | ○ | ○ | ○ | ○ |

TABLE 23

| Evaluation item | Ink No. N | O | P | Q | R | S |
|---|---|---|---|---|---|---|
| | Viscosity 20 | 15 | 10 | 5 | 3 | 1.5 |
| Density of picture element | 0.55 | 0.53 | 0.52 | 0.50 | 0.50 | 0.49 |
| Shape of ink dot | Δ | ○ | ○ | ○ | ○ | ○ |
| Degree of ink spread | 3.8 | 3.7 | 3.7 | 3.6 | 3.6 | 3.6 |
| Clearness of image color | ○ | ○ | ○ | ○ | ○ | ○ |
| Ink absorbability | × | ○ | ○ | ○ | ○ | ○ |

TABLE 24

| Evaluation item | Ink No. N | O | P | Q | R | S |
|---|---|---|---|---|---|---|
| | Viscosity 20 | 15 | 10 | 5 | 3 | 1.5 |
| Density of picture element | 0.36 | 0.36 | 0.40 | 0.40 | 0.43 | 0.47 |
| Shape of ink dot | × | × | × | × | × | × |
| Degree of ink spread | 2.5 | 2.5 | 3.0 | 3.0 | 3.3 | 3.3 |
| Clearness of image color | Δ | Δ | Δ | Δ | Δ | Δ |
| Ink absorbability | ○ | ○ | ○ | ○ | ○ | ○ |

TABLE 25

| Evaluation item | Ink No. N | O | P | Q | R | S |
|---|---|---|---|---|---|---|
| | Viscosity 20 | 15 | 10 | 5 | 3 | 1.5 |
| Density of picture element | 0.36 | 0.34 | 0.33 | 0.30 | 0.30 | 0.29 |
| Shape of ink dot | Δ | Δ | ○ | ○ | ○ | ○ |
| Degree of ink spread | 3.5 | 3.5 | 3.5 | 3.2 | 3.0 | 3.0 |
| Clearness of image color | Δ | Δ | Δ | Δ | Δ | Δ |
| Ink absorbability | × | × | × | × | × | × |

TABLE 26

| Evaluation item | Recording medium: Paper of Example 13, Ambient temperature (°C.) 5 | 25 | 40 | Paper of Comparative Example 9, 5 | 25 | 40 | Paper of Comparative Example 10, 5 | 25 | 40 |
|---|---|---|---|---|---|---|---|---|---|
| Density of picture element | 0.68 | 0.72 | 0.75 | 0.37 | 0.40 | 0.42 | 0.28 | 0.30 | 0.33 |
| Shape of ink dot | ○ | ○ | ○ | × | × | × | ○ | ○ | ○ |
| Degree of ink speed | 4.2 | 4.4 | 4.5 | 2.8 | 3.0 | 3.3 | 3.0 | 3.2 | 3.3 |
| Clearness of image color | ○ | ○ | ○ | Δ | Δ | Δ | Δ | Δ | Δ |
| Ink absorbability | ○ | ○ | ○ | ○ | ○ | ○ | × | × | × |

TABLE 27

| Evaluation item | Ink No. N | O | P | Q | R | S |
|---|---|---|---|---|---|---|
| | Viscosity 20 | 15 | 10 | 5 | 3 | 1.5 |
| Density of picture element | 0.49 | 0.49 | 0.48 | 0.48 | 0.46 | 0.45 |

TABLE 27-continued

| Evaluation item | Ink No. N | O | P | Q | R | S |
|---|---|---|---|---|---|---|
| | Viscosity 20 | 15 | 10 | 5 | 3 | 1.5 |
| Shape of ink dot | ○ | ○ | ○ | ○ | ○ | ○ |
| Degree of ink spread | 4.0 | 3.9 | 3.8 | 3.8 | 3.8 | 3.8 |
| Clearness of image color | ○ | ○ | ○ | ○ | ○ | ○ |
| Ink absorbability | ○ | ○ | ○ | ○ | ○ | ○ |

TABLE 28

| Evaluation item | Ink No. N | O | P | O | R | S |
|---|---|---|---|---|---|---|
| | Viscosity 20 | 15 | 10 | 5 | 3 | 1.5 |
| Density of picture element | 0.69 | 0.68 | 0.68 | 0.67 | 0.67 | 0.66 |
| Shape of ink dot | ○ | ○ | ○ | ○ | ○ | ○ |
| Degree of ink spread | 5.0 | 4.8 | 4.8 | 4.7 | 4.7 | 4.5 |
| Clearness of image color | ◎ | ◎ | ◎ | ◎ | ◎ | ◎ |
| Ink absorbability | × | ○ | ○ | ○ | ○ | ○ |

TABLE 29

| Evaluation item | Ink No. N | O | P | Q | R | S |
|---|---|---|---|---|---|---|
| | Viscosity 20 | 15 | 10 | 5 | 3 | 1.5 |
| Density of picture element | 0.65 | 0.63 | 0.62 | 0.60 | 0.60 | 0.58 |
| Shape of ink dot | Δ | ○ | ○ | ○ | ○ | ○ |
| Degree of ink spread | 3.8 | 3.7 | 3.7 | 3.6 | 3.6 | 3.6 |
| Clearness of image color | ○ | ○ | ○ | ○ | ○ | ○ |
| Ink absorbability | × | ○ | ○ | ○ | ○ | ○ |

TABLE 30

| Evaluation item | Ink No. N | O | P | Q | R | S |
|---|---|---|---|---|---|---|
| | Viscosity 20 | 15 | 10 | 5 | 3 | 1.5 |
| Density of picture element | 0.36 | 0.36 | 0.40 | 0.40 | 0.43 | 0.47 |
| Shape of | × | × | × | × | × | × |

TABLE 30-continued

| Evaluation item | Ink No. N | O | P | Q | R | S |
|---|---|---|---|---|---|---|
| | Viscosity 20 | 15 | 10 | 5 | 3 | 1.5 |
| ink dot Degree of ink spread | 2.5 | 2.5 | 3.0 | 3.0 | 3.3 | 3.3 |
| Clearness of image color | Δ | Δ | Δ | Δ | Δ | Δ |
| Ink absorbability | ○ | ○ | ○ | ○ | ○ | ○ |

TABLE 31

| Evaluation item | Ink No. N | O | P | Q | R | S |
|---|---|---|---|---|---|---|
| | Viscosity 20 | 15 | 10 | 5 | 3 | 1.5 |
| Density of picture element | 0.36 | 0.34 | 0.33 | 0.30 | 0.30 | 0.29 |
| Shape of ink dot | Δ | Δ | ○ | ○ | ○ | ○ |
| Degree of ink spread | 3.5 | 3.5 | 3.5 | 3.2 | 3.0 | 3.0 |
| Clearness of image color | Δ | Δ | Δ | Δ | Δ | Δ |
| Ink absorbability | × | × | × | × | × | × |

TABLE 32

| Evaluation item | Recording medium: Paper of Example 17 | | | Paper of Comparative Example 11 | | | Paper of Comparative Example 12 | | |
|---|---|---|---|---|---|---|---|---|---|
| | Ambient temperature (°C.) 5 | 25 | 40 | 5 | 25 | 40 | 5 | 25 | 40 |
| Density of picture element | 0.44 | 0.46 | 0.49 | 0.37 | 0.40 | 0.42 | 0.28 | 0.30 | 0.33 |
| Shape of ink dot | ○ | ○ | ○ | × | × | × | ○ | ○ | ○ |
| Degree of ink speed | 3.6 | 3.8 | 3.9 | 2.8 | 3.0 | 3.3 | 3.0 | 3.2 | 3.3 |
| Clearness of image color | ○ | ○ | ○ | Δ | Δ | Δ | Δ | Δ | Δ |
| Ink absorbability | ○ | ○ | ○ | ○ | ○ | ○ | × | × | × |

What is claimed is:

1. A method of ink-jet recording comprising the steps of:

providing an ink-jet recording medium comprising a layer of fibrous material having filler particles bound thereto providing at the surface of the recording medium a recording surface layer containing a mixture of said filler particles and said fibrous material, wherein said layer of fibrous material comprises a base layer underlying said recording surface layer; and depositing ink on said medium, said ink having a surface tension of about 30 to 60 dyne/cm at 20° C.

2. The ink-jet recording method of claim 1, wherein the thickness of said recording surface layer of the recording medium is in the range of 0.5 to 10 microns.

3. The ink-jet recording method of claim 1, wherein at least some of said filler particles and at least some of said fibrous material are exposed at the surface of said recording surface layer and said filler particles are bound to the surface of said base layer by a binder.

4. The ink-jet recording method of claim 1, wherein the recording medium further comprises a bottom support layer underlying said base layer.

5. The ink-jet recording method of claim 1, wherein the ink has a surface tension of about 35 to 55 dyne/cm.

6. The ink-jet recording method of claim 1, wherein the ink has a surface tension of about 40 to 50 dyne/cm.

7. The recording method of claim 1, wherein the sizes of the filler particles are in the range of 0.05 to 50 μm.

8. The recording method of claim 1, wherein the filler particles are selected from silica, clay, talc, kaolin, diatomaceous earth, calcium carbonate.

9. A method of ink-jet recording comprising the steps of:

providing an ink-jet recording medium comprising a layer of fibrous material having filler particles bound thereto providing at the surface of the recording medium a recording surface layer containing a mixture of said filler particles and said fibrous material, wherein said layer of fibrous material comprises a base layer underlying said recording surface layer; and depositing ink on said medium, said ink having a viscosity of up to 20 cp at 25° C. ,82

10. The ink-jet recording method of claim 9, wherein the thickness of said recording surface layer of the recording medium is in the range of 0.5 to 10 microns.

11. The ink-jet recording method of claim 9, wherein at least some of said filler particles and at least some of said fibrous material are exposed at the surface of said recording surface layer and said filler particles are bound to the surface of said base layer by a binder.

12. The ink-jet recording method of claim 9, wherein the recording medium comprise a bottom support layer underlying said base layer.

13. The ink-jet recording methiod of claim 9, wherein the ink has a viscosity of 1.5 to 20 cp.

* * * * *